US010079137B2

(12) United States Patent
Bloomfield

(10) Patent No.: US 10,079,137 B2
(45) Date of Patent: Sep. 18, 2018

(54) RAPID SCANNING OF WIDE QUADRUPOLE RF WINDOWS WHILE TOGGLING FRAGMENTATION ENERGY

(71) Applicant: DH Technologies Development Pte. Ltd., Singapore (SG)

(72) Inventor: Nic G. Bloomfield, Newmarket (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/544,021

(22) PCT Filed: Jan. 29, 2016

(86) PCT No.: PCT/IB2016/050483
§ 371 (c)(1),
(2) Date: Jul. 16, 2017

(87) PCT Pub. No.: WO2016/125061
PCT Pub. Date: Aug. 11, 2016

(65) Prior Publication Data

US 2018/0012742 A1 Jan. 11, 2018

Related U.S. Application Data

(60) Provisional application No. 62/112,603, filed on Feb. 5, 2015.

(51) Int. Cl.
*H01J 49/00* (2006.01)
*H01J 49/04* (2006.01)
*H01J 49/06* (2006.01)

(52) U.S. Cl.
CPC ..... *H01J 49/0045* (2013.01); *H01J 49/04* (2013.01); *H01J 49/063* (2013.01)

(58) Field of Classification Search
CPC .... H01J 49/004; H01J 49/0045; H01J 49/005; H01J 49/0054; H01J 49/0063;
(Continued)

(56) References Cited

U.S. PATENT DOCUMENTS 8,237,106 B2 * 8/2012 Castro-Perez ..... H01J 49/0031 250/281
2011/0204218 A1 * 8/2011 Hager ..... H01J 49/0031 250/282

(Continued)

FOREIGN PATENT DOCUMENTS

WO 2007129107 A2 11/2007
WO 2013171556 A1 11/2013
WO 2014195785 A1 12/2014

OTHER PUBLICATIONS

International Search Report and Written Opinion for PCT/IB2016/050483, dated May 17, 2016.

*Primary Examiner* — David E Smith
(74) *Attorney, Agent, or Firm* — John R. Kasha; Kelly L. Kasha; Kasha Law LLC

(57) ABSTRACT

A sample is ionized using an ion source and the ion beam is received using a tandem mass spectrometer. An m/z range is divided into two or more precursor ion isolation windows. Two or more values for a fragmentation parameter are selected. A first value of the two or more values for the fragmentation parameter has a level that fragments a minimal amount of ions of the ion beam. The one or more additional values have increasingly aggressive levels that produce increasingly more fragmentation of the ions of the ion beam. For each precursor ion isolation window, the tandem mass spectrometer is instructed to perform a selection and fragmentation of the ion beam using the precursor ion isolation window and the first value and is instructed to perform one or more additional selections and fragmenta-
(Continued)

tions of the ion beam using the precursor ion isolation window and using the one or more additional values.

19 Claims, 11 Drawing Sheets

(58) Field of Classification Search
CPC ..... H01J 49/0068; H01J 49/0072; H01J 49/0077; H01J 49/0081; H01J 49/0086; H01J 49/0027; H01J 49/0031; H01J 49/06; H01J 49/062; H01J 49/063
See application file for complete search history.

(56) References Cited

U.S. PATENT DOCUMENTS

| | | | | |
|---|---|---|---|---|
| 2013/0206979 | A1* | 8/2013 | Bonner ..... | H01J 49/0031 250/282 |
| 2013/0228678 | A1 | 9/2013 | Savitski et al. | |
| 2013/0240723 | A1* | 9/2013 | Bonner ..... | H01J 49/0045 250/282 |
| 2013/0289894 | A1* | 10/2013 | Cox ..... | H01J 49/0031 702/23 |

* cited by examiner

100

RAPID SCANNING OF WIDE QUADRUPOLE RF WINDOWS WHILE TOGGLING FRAGMENTATION ENERGY

CROSS REFERENCE TO RELATED APPLICATION

This application claims the benefit of U.S. Provisional Patent Application Ser. No. 62/112,603, filed Feb. 5, 2015, the content of which is incorporated by reference herein in its entirety.

INTRODUCTION

Various embodiments relate generally to mass spectrometry, and more particularly to systems and methods for providing precursor ion information in data independent acquisition (DIA) tandem mass spectrometry methods that allows product ions and precursor ions to be correlated.

Tandem mass spectrometry, or mass spectrometry/mass spectrometry (MS/MS) is a well-known technique for analyzing compounds. Originally a tandem mass spectrometer was thought of as two mass spectrometers arranged in tandem. However, modern tandem mass spectrometers are much more complex instruments and may have many different configurations. Generally, however, tandem mass spectrometry involves ionization of one or more compounds from a sample, selection of one or more precursor ions of the one or more compounds, fragmentation of the one or more precursor ions into product ions, and mass analysis of the product ions.

Tandem mass spectrometry can provide both qualitative and quantitative information. The product ion spectrum can be used to identify a molecule of interest. The intensity of one or more product ions can be used to quantitate the amount of the compound present in a sample.

A large number of different types of experimental methods or workflows can be performed using a tandem mass spectrometer. Two broad categories of these workflows are information dependent acquisition (IDA) and data independent acquisition (DIA).

IDA is a flexible tandem mass spectrometry method in which a user can specify criteria for performing MS/MS while a sample is being introduced into the tandem mass spectrometer. For example, in an IDA method a precursor ion or mass spectrometry (MS) survey scan is performed to generate a precursor ion peak list. The user can select criteria to filter the peak list for a subset of the precursor ions on the peak list. MS/MS is then performed on each precursor ion of the subset of precursor ions. A product ion spectrum is produced for each precursor. MS/MS is repeatedly performed on the precursor ions of the subset of precursor ions. The sample is being introduced into the tandem mass spectrometer. The sample is introduced through an injection or chromatographic run, for example.

One type of IDA method is called multiple reaction monitoring (MRM) or selected reaction monitoring (SRM) or as an MRM or SRM scan or transition. MRM is typically used for quantitative analysis. In other words, MRM is typically used to quantify the amount of a precursor ion in a sample from the intensity of a single product ion. MRM is for multi-analyte screening methods, which include drug testing and pesticide screening methods, among others.

However, in proteomics, and many other sample types, the complexity and dynamic range of compounds is very large. This poses challenges for traditional IDA workflows, requiring very high speed MS/MS acquisition to deeply interrogate the sample in order to both identify and quantify a broad range of analytes. As a result, DIA workflows have been used to increase the reproducibility and comprehensiveness of data collection.

In a traditional DIA workflow, the actions of the tandem mass spectrometer are not varied from scan to scan based on data acquired in a previous scan. Instead a precursor ion mass range is selected. All precursor ions in that mass range are then fragmented, and all of the product ions of all of the precursor ions are mass analyzed. This precursor ion mass range can be very narrow, where the likelihood of multiple precursors within the window is small. Or, this window can be large, and the likelihood of multiple precursors within this window is high.

Other names for DIA can include, but are not limited to, $MS/MS^{ALL}$ or a non-specific fragmentation method. SWATH™ acquisition is also a type of DIA workflow. In SWATH™ acquisition, a precursor ion mass isolation window is stepped across an entire mass range. All the precursor ions in each mass isolation window are fragmented, and all of the product ions of all of the precursor ions in each mass isolation window are mass analyzed.

DIA workflows, however, are not without limitations. For example, in conventional SWATH™ acquisition, it is difficult to de-convolve co-eluting products ions that occur in the same precursor mass isolation window. The non-specific nature of DIA workflows does not provide enough precursor ion information to aid in the deconvolution.

SUMMARY

A system is disclosed for providing precursor ion information in a tandem mass spectrometry data independent acquisition (DIA) experiment by fragmenting each precursor ion isolation window two or more times with different values for a fragmentation parameter, for example. The system includes an ion source, a tandem mass spectrometer, and a processor in communication with the tandem mass spectrometer.

The ion source is configured to receive a sample and ionize the sample, producing an ion beam. The tandem mass spectrometer is configured to receive the ion beam and analyze an m/z range of the ion beam.

The processor divides the m/z range into two or more precursor ion isolation windows, and selects two or more values for a fragmentation parameter. A first value of the two or more values for the fragmentation parameter has a level that fragments a minimal amount of ions of the ion beam. One or more additional values of the two or more values for the fragmentation parameter have increasingly aggressive levels that produce increasingly more fragmentation of the ions of the ion beam.

For each precursor ion isolation window of the two or more precursor ion isolation windows, the processor instructs the tandem mass spectrometer to perform a selection and fragmentation of the ion beam using the each precursor ion isolation window and using the first value. The processor then instructs the tandem mass spectrometer to perform one or more additional selections and fragmentations of the ion beam using the each precursor ion isolation window and using the one or more additional values. A product ion spectrum is produced for each value of the two or more values for the fragmentation parameter.

A method is disclosed for providing precursor ion information in a tandem mass spectrometry DIA experiment by fragmenting each precursor ion isolation window two or more times with different values for a fragmentation parameter. A sample is ionized using an ion source, producing an ion beam. The ion beam is received using a tandem mass spectrometer. An m/z range is divided into two or more precursor ion isolation windows using a processor.

Two or more values for a fragmentation parameter are selected using the processor. A first value of the two or more values for the fragmentation parameter has a level that fragments a minimal amount of ions of the ion beam. One or more additional values of the two or more values for the fragmentation parameter have increasingly aggressive levels that produce increasingly more fragmentation of the ions of the ion beam.

For each precursor ion isolation window of the two or more precursor ion isolation windows, the tandem mass spectrometer is instructed to perform a selection and fragmentation of the ion beam using the each precursor ion isolation window and using the first value, and is instructed to perform one or more additional selections and fragmentations of the ion beam using the each precursor ion isolation window and using the one or more additional values. A product ion spectrum is produced for each value of the two or more values for the fragmentation parameter.

A computer program product is disclosed that includes a non-transitory and tangible computer-readable storage medium whose contents include a program with instructions being executed on a processor so as to perform a method for providing precursor ion information in a tandem mass spectrometry DIA experiment by fragmenting each precursor ion isolation window two or more times with different values for a fragmentation parameter. The method includes providing a system, wherein the system comprises one or more distinct software modules, and wherein the distinct software modules comprise a control module.

The control module divides an m/z range of an ion beam to be analyzed by a tandem mass spectrometer into two or more precursor ion isolation windows. The tandem mass spectrometer receives the ion beam from an ion source that ionizes a sample. The control module selects two or more values for a fragmentation parameter. A first value of the two or more values for the fragmentation parameter has a level that fragments a minimal amount of ions of the ion beam. One or more additional values of the two or more values for the fragmentation parameter have increasingly aggressive levels that produce increasingly more fragmentation of the ions of the ion beam.

For each precursor ion isolation window of the two or more precursor ion isolation windows, the control module instructs the tandem mass spectrometer to perform a selection and fragmentation of the ion beam using the each precursor ion isolation window and using the first value, and instructs the tandem mass spectrometer to perform one or more additional selections and fragmentations of the ion beam using the each precursor ion isolation window and using the one or more additional values. A product ion spectrum is produced for each value of the two or more values for the fragmentation parameter.

These and other features of the applicant's teachings are set forth herein.

BRIEF DESCRIPTION OF THE DRAWINGS

The skilled artisan will understand that the drawings, described below, are for illustration purposes only. The drawings are not intended to limit the scope of the present teachings in any way.

Figure 1:
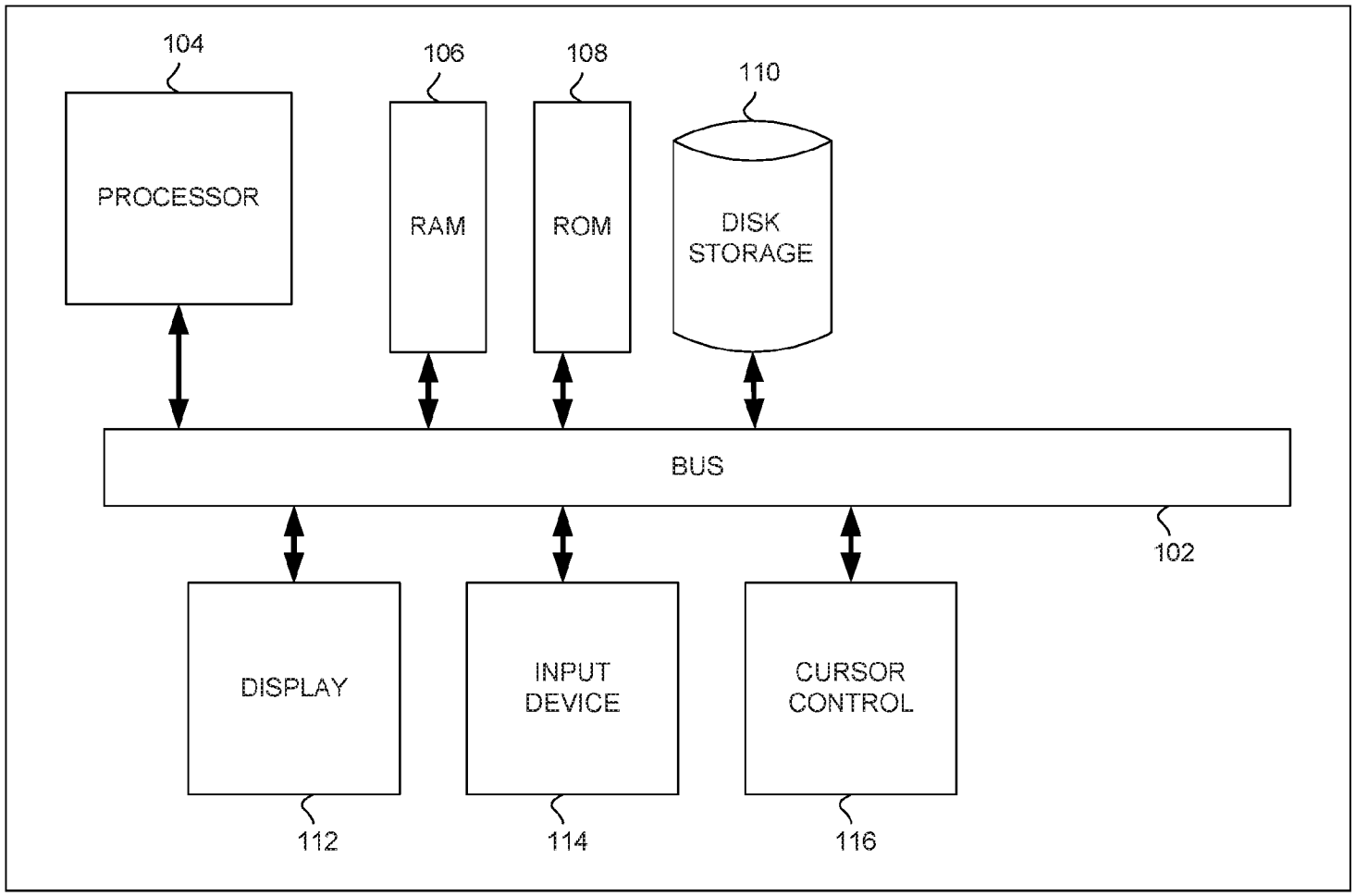
FIG. 1 is a block diagram that illustrates a computer system, upon which embodiments of the present teachings may be implemented.

Before one or more embodiments of the present teachings are described in detail, one skilled in the art will appreciate that the present teachings are not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

Description of Various Embodiments

Computer-Implemented System

FIG. 1 is a block diagram that illustrates a computer system 100, upon which embodiments of the present teachings may be implemented. Computer system 100 includes a bus 102 or other communication mechanism for communicating information, and a processor 104 coupled with bus 102 for processing information. Computer system 100 also includes a memory 106, which can be a random access memory (RAM) or other dynamic storage device, coupled to bus 102 for storing instructions to be executed by processor 104. Memory 106 also may be used for storing temporary variables or other intermediate information during execution of instructions to be executed by processor 104. Computer system 100 further includes a read only memory (ROM) 108 or other static storage device coupled to bus 102 for storing static information and instructions for processor 104. A storage device 110, such as a magnetic disk or optical disk, is provided and coupled to bus 102 for storing information and instructions.

Computer system 100 may be coupled via bus 102 to a display 112, such as a cathode ray tube (CRT) or liquid crystal display (LCD), for displaying information to a computer user. An input device 114, including alphanumeric and other keys, is coupled to bus 102 for communicating information and command selections to processor 104. Another type of user input device is cursor control 116, such as a mouse, a trackball or cursor direction keys for communicating direction information and command selections to processor 104 and for controlling cursor movement on display 112. This input device typically has two degrees of freedom in two axes, a first axis (i.e., x) and a second axis (i.e., y), that allows the device to specify positions in a plane.

A computer system 100 can perform the present teachings. Consistent with certain implementations of the present teachings, results are provided by computer system 100 in response to processor 104 executing one or more sequences of one or more instructions contained in memory 106. Such instructions may be read into memory 106 from another computer-readable medium, such as storage device 110. Execution of the sequences of instructions contained in memory 106 causes processor 104 to perform the process described herein. Alternatively hard-wired circuitry may be used in place of or in combination with software instructions to implement the present teachings. Thus implementations of the present teachings are not limited to any specific combination of hardware circuitry and software.

In various embodiments, computer system 100 can be connected to one or more other computer systems, like computer system 100, across a network to form a networked system. The network can include a private network or a public network such as the Internet. In the networked system, one or more computer systems can store and serve the data to other computer systems. The one or more computer systems that store and serve the data can be referred to as servers or the cloud, in a cloud computing scenario. The one or more computer systems can include one or more web servers, for example. The other computer systems that send and receive data to and from the servers or the cloud can be referred to as client or cloud devices, for example.

The term "computer-readable medium" as used herein refers to any media that participates in providing instructions to processor 104 for execution. Such a medium may take many forms, including but not limited to, non-volatile media, volatile media, and transmission media. Non-volatile media includes, for example, optical or magnetic disks, such as storage device 110. Volatile media includes dynamic memory, such as memory 106. Transmission media includes coaxial cables, copper wire, and fiber optics, including the wires that comprise bus 102.

Common forms of computer-readable media or computer program products include, for example, a floppy disk, a flexible disk, hard disk, magnetic tape, or any other magnetic medium, a CD-ROM, digital video disc (DVD), a Blu-ray Disc, any other optical medium, a thumb drive, a memory card, a RAM, PROM, and EPROM, a FLASH-EPROM, any other memory chip or cartridge, or any other tangible medium from which a computer can read.

Various forms of computer readable media may be involved in carrying one or more sequences of one or more instructions to processor 104 for execution. For example, the instructions may initially be carried on the magnetic disk of a remote computer. The remote computer can load the instructions into its dynamic memory and send the instructions over a telephone line using a modem. A modem local to computer system 100 can receive the data on the telephone line and use an infra-red transmitter to convert the data to an infra-red signal. An infra-red detector coupled to bus 102 can receive the data carried in the infra-red signal and place the data on bus 102. Bus 102 carries the data to memory 106, from which processor 104 retrieves and executes the instructions. The instructions received by memory 106 may optionally be stored on storage device 110 either before or after execution by processor 104.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

The following descriptions of various implementations of the present teachings have been presented for purposes of illustration and description. It is not exhaustive and does not limit the present teachings to the precise form disclosed. Modifications and variations are possible in light of the above teachings or may be acquired from practicing of the present teachings. Additionally, the described implementation includes software but the present teachings may be implemented as a combination of hardware and software or in hardware alone. The present teachings may be implemented with both object-oriented and non-object-oriented programming systems.

Systems and Methods for Providing Precursor Ion Data

As described above, various embodiments relate particularly to systems and methods for providing precursor ion information in data independent acquisition (DIA) tandem mass spectrometry methods that allows product ions and precursor ions to be correlated. Two broad categories of tandem mass spectrometry workflows are information dependent acquisition (IDA) and DIA.

In IDA, precursor information is provided by performing a precursor ion or mass spectrometry (MS) survey scan. Precursor ions are then selected for fragmentation from the resulting precursor ion spectrum. Generally, correlation of product ions with precursor ions in IDA methods is straightforward, since narrow precursor ion isolation windows are used for fragmentation.

In contrast, in DIA methods wide precursor ion isolation windows are used, allowing many precursor ions to be fragmented at the same time. As a result, in conventional SWATH™ acquisition, for example, it is difficult to deconvolve co-eluting products ions that occur in the same precursor ion mass isolation window. The non-specific nature of DIA workflows does not provide enough precursor ion information to aid in the deconvolution.

In various embodiments, DIA workflows are improved by providing additional precursor ion information. In particular, in a DIA workflow a tandem mass spectrometer is instructed to perform one or more looped experiments for each precursor ion mass isolation window. In a first experiment, a precursor ion mass isolation window is selected and fragmented without a significant collision energy. This allows precursor ions to be mass analyzed intact. In the one or more additional experiments performed on the same precursor ion mass isolation window, the collision energy is incrementally increased. The results from these one or more additional experiments have increasing product ion intensities and decreasing residual precursor ion intensities.

Figure 2:
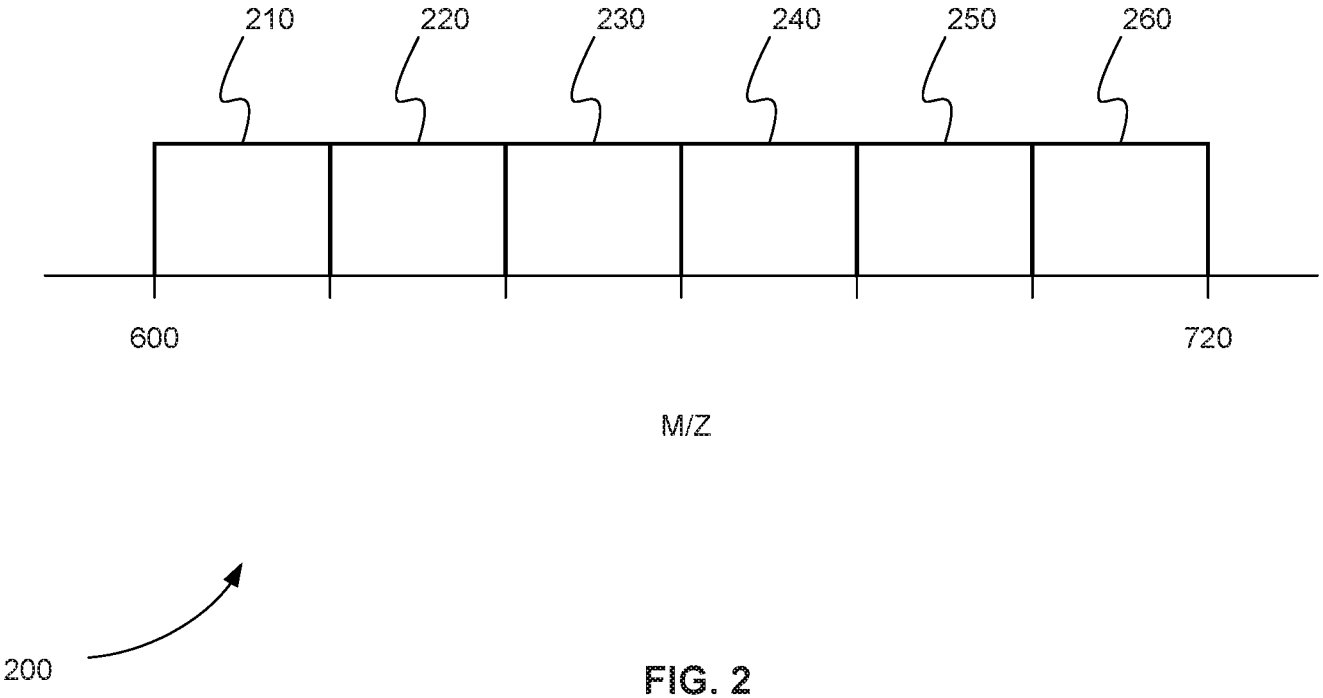
FIG. 2 is an exemplary diagram of a precursor ion mass-to-charge ratio (m/z) range that is divided into six precursor ion mass isolation windows for a data independent acquisition (DIA) workflow, in accordance with various embodiments.

FIG. 2 is an exemplary diagram 200 of a precursor ion mass-to-charge ratio (m/z) range that is divided into six precursor ion mass isolation windows for a DIA workflow, in accordance with various embodiments. The m/z range shown in FIG. 2 is 120 m/z. Note that the terms "mass" and "m/z" are used interchangeably herein. Generally, mass spectrometry measurements are made in m/z and converted to mass by dividing by charge.

Each of the six precursor ion mass isolation windows 210-260 spans 20 m/z. Precursor ion mass isolation windows 210-260 are shown as non-overlapping windows with the same width. In various embodiments, precursor ion mass isolation windows can overlap and/or can have variable widths. In a conventional SWATH™ acquisition, each of precursor ion mass isolation windows 210-260 is selected and then fragmented, producing six product ion spectra for the entire m/z range.

The method can further be coupled with a sample introduction device that provides the sample over time, for example. As a result, for each time step, each of precursor ion mass isolation windows 210-260 is selected and then fragmented, producing six product ion spectra for the entire m/z range. A sample introduction device can introduce a sample to the mass spectrometer using a technique that includes, but is not limited to, injection, liquid chromatography, gas chromatography, capillary electrophoresis, or ion mobility.

In various embodiments, instead of selecting and fragmenting each of precursor ion mass isolation windows 210-260 just once across the entire m/z range, each of precursor ion mass isolation windows 210-260 is selected and fragmented two or more times with different collision energies. In addition, a first collision energy is low enough to prevent fragmentation of precursor ions. In other words, the first selection and fragmentation of each of precursor ion mass isolation windows 210-260 selects but does not fragment the precursor ions, allowing them flow through intact. Subsequent selections and fragmentations of each of precursor ion mass isolation windows 210-260 use increasingly higher collision energies to fragment the precursor ions.

Figure 3:
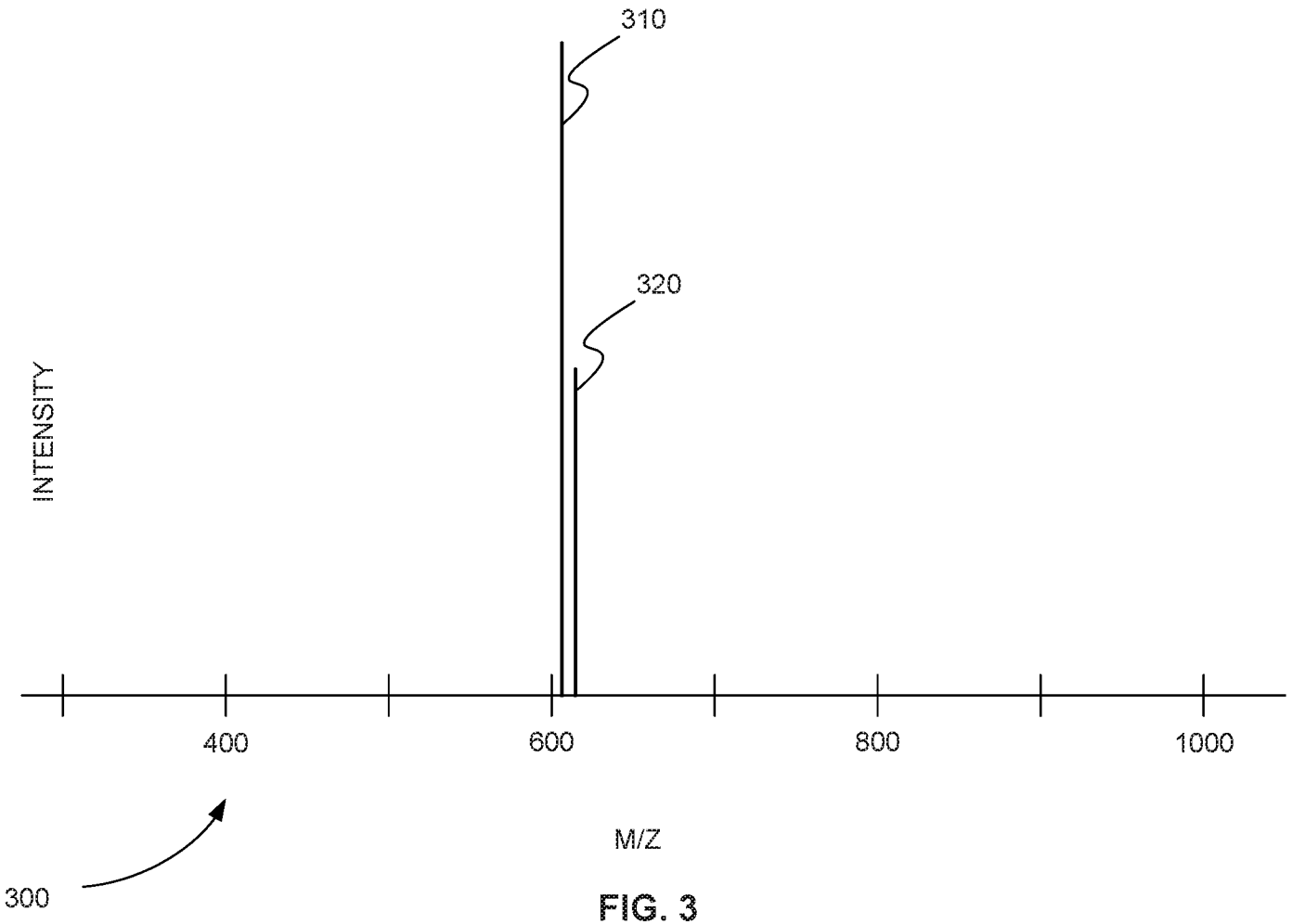
FIG. 3 is an exemplary plot of a portion of a product ion mass spectrum produced from a first selection and fragmentation of the first precursor ion mass isolation window shown in FIG. 2 using a first collision energy low enough to prevent fragmentation of precursor ions, in accordance with various embodiments.

FIG. 3 is an exemplary plot 300 of a portion of a product ion mass spectrum produced from a first selection and fragmentation of the first precursor ion mass isolation window shown in FIG. 2 using a first collision energy low enough to prevent fragmentation of precursor ions, in accordance with various embodiments. As a result, only two precursor ions 310 and 320 are found in the product ion spectrum. No product ions for precursor ions 310 and 320 are found in the product ion spectrum, because the precursor ions were not fragmented. The first precursor ion mass isolation window shown in FIG. 2 is precursor ion mass isolation window 210, for example.

Figure 4:
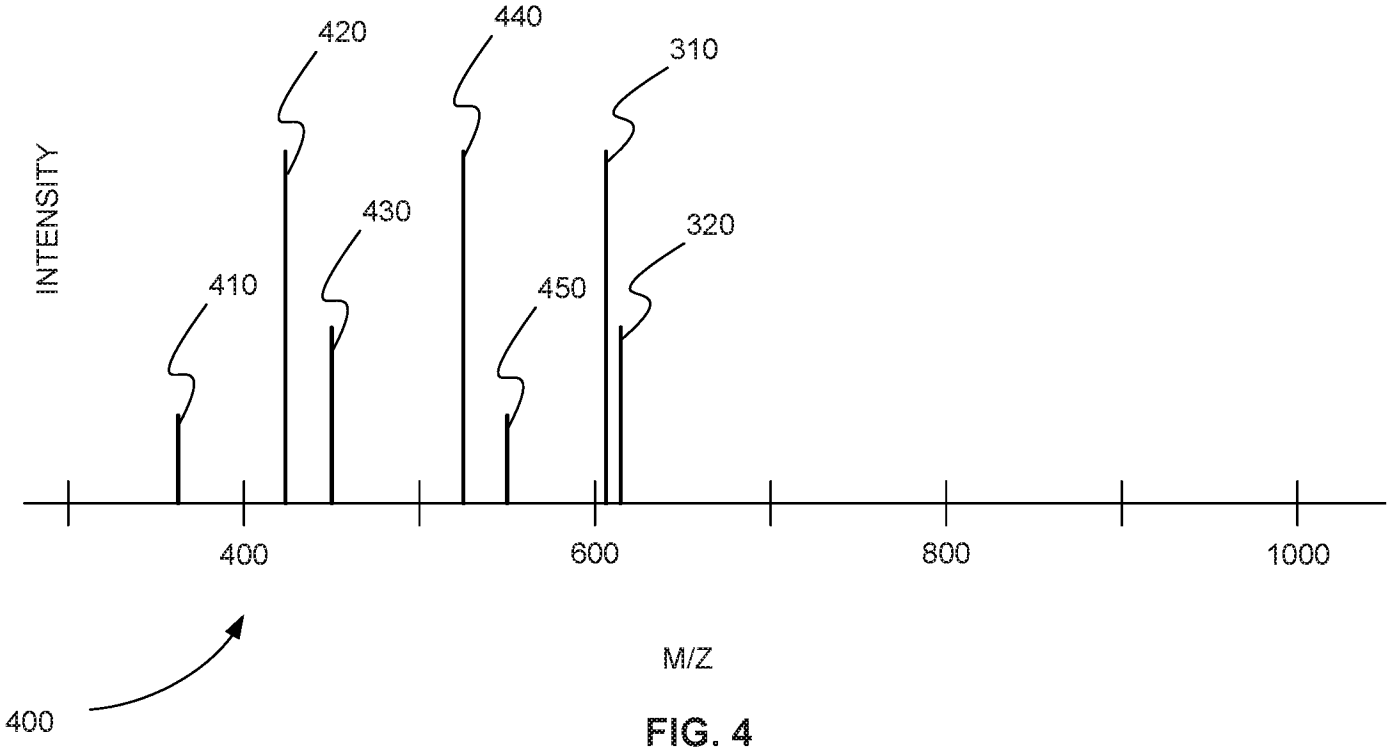
FIG. 4 is an exemplary plot of a portion of a product ion mass spectrum produced from a second selection and fragmentation of the first precursor ion mass isolation window shown in FIG. 2 using a second collision energy high enough to fragment the precursor ions of the first precursor ion mass isolation window, in accordance with various embodiments.

FIG. 4 is an exemplary plot 400 of a portion of a product ion mass spectrum produced from a second selection and fragmentation of the first precursor ion mass isolation window shown in FIG. 2 using a second collision energy high enough to fragment the precursor ions of the first precursor ion mass isolation window, in accordance with various embodiments. The product ion spectrum shows residual precursor ions 310 and 320, but their intensities are reduced. The product ion mass spectrum also now shows product ions 410-450 that are produced by precursor ions 310 and 320.

Figure 5:
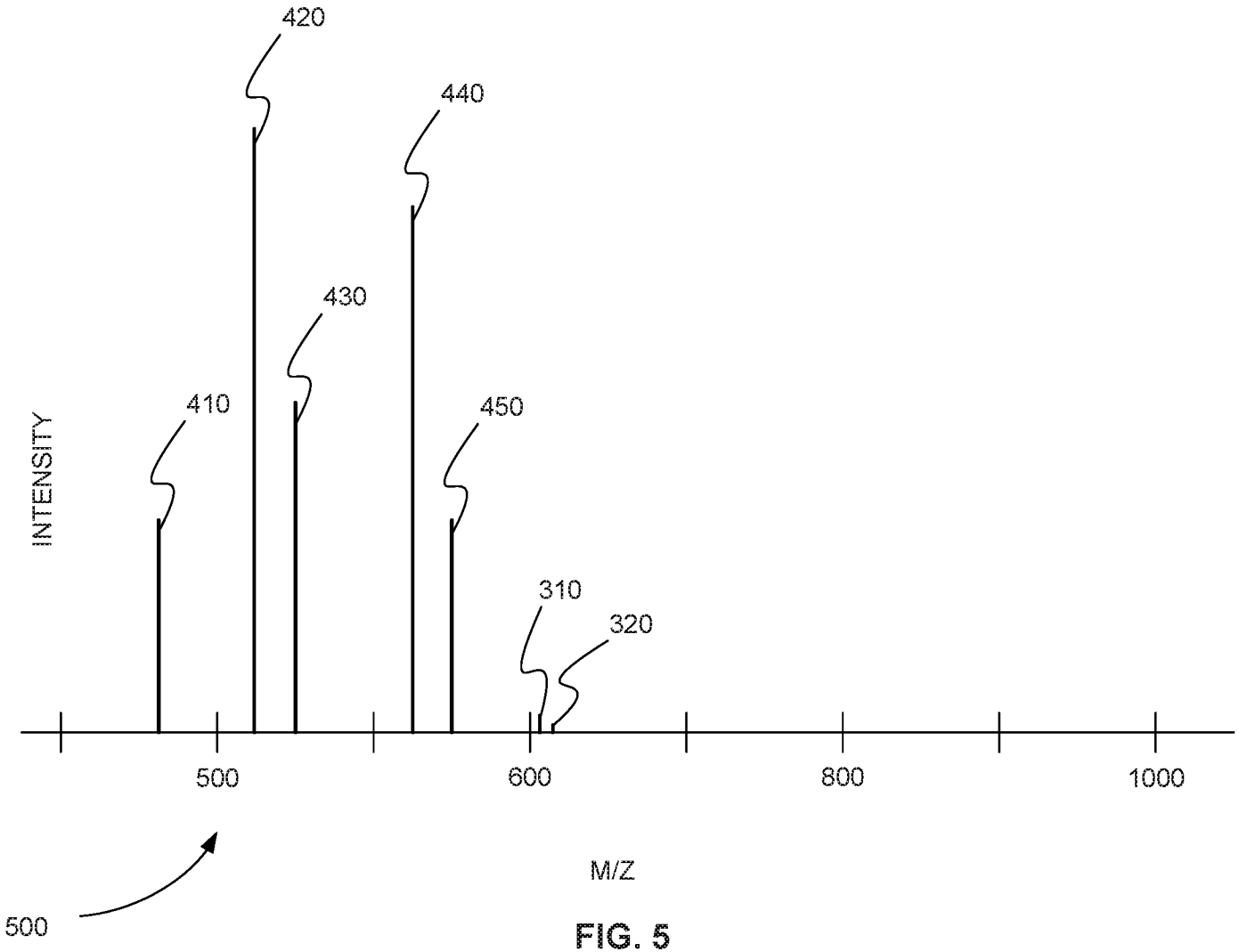
FIG. 5 is an exemplary plot of a portion of a product ion mass spectrum produced from a third selection and fragmentation of the first precursor ion mass isolation window shown in FIG. 2 using a third collision energy that is higher than the second collision energy, in accordance with various embodiments.

FIG. 5 is an exemplary plot 500 of a portion of a product ion mass spectrum produced from a third selection and fragmentation of the first precursor ion mass isolation window shown in FIG. 2 using a third collision energy that is higher than the second collision energy, in accordance with various embodiments. The product ion spectrum still shows residual precursor ions 310 and 320, but their intensities are almost undetectable. The product ion mass spectrum also shows product ions 410-450 with even greater intensities as a result of even greater fragmentation of precursor ions 310 and 320.

FIGS. 3-5 show the spectra collected for just one precursor ion mass isolation window of FIG. 2. Similar, spectra are also collected for the other five precursor ion mass isolation windows of FIG. 2 in order to analyze the entire m/z range. The spectra for each of the three different collision energies can be combined, producing a spectrum for each collision energy.

If a sample introduction device provides a sample over time, intensity traces can be calculated for each m/z of each spectrum of each collision energy. However, the time of the intensity traces is not a chromatographic time. The time over which each of the intensity trace is calculated is the time that the mass filtering of the m/z range is performed by Q1. In various embodiments, a product ion of a precursor ion is then found by correlating intensity traces of product ions to intensity traces of the precursor ions found with the lowest or non-fragmenting collision energy.

An intensity trace is a set of intensities of a particular ion correlated across any dimension. In addition, the dimension might not be directly measured but obtained after some transformation of a measured dimension. One exemplary dimension is time. One exemplary intensity trace correlated over time is a first quadrupole (Q1) intensity trace.

Figure 6:
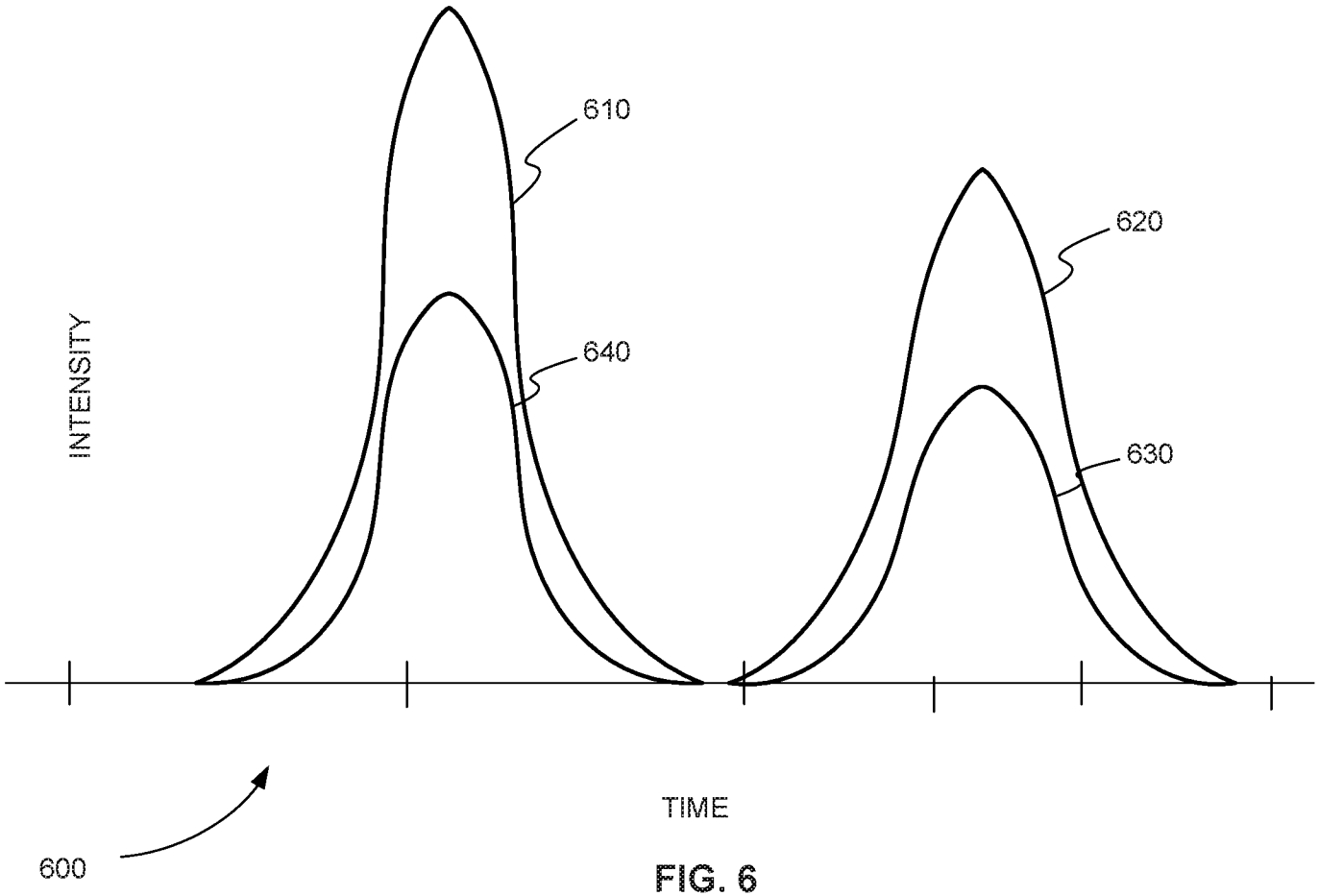
FIG. 6 is an exemplary plot of intensity traces calculated for the precursor ions of FIG. 3 and two of the product ions of FIG. 5, in accordance with various embodiments.

FIG. 6 is an exemplary plot 600 of intensity traces calculated for the precursor ions of FIG. 3 and two of the product ions of FIG. 5, in accordance with various embodiments. On comparing FIG. 3 and FIG. 5, it is not possible to determine which product ions 410-450 in FIG. 5 correspond to which precursor ions 310 and 320 in FIG. 3. However, if the intensity traces for precursor ions selected and fragmented with the lowest and non-fragmenting collision energies are compared with the intensity traces of product ions selected and fragmented with collision energies high enough to fragment the precursor ions, the precursor ions of the product ions can be found. In FIG. 6, intensity trace 610 is calculated from the intensity of precursor ion 310 in the product ion spectrum of FIG. 3 and from intensities of precursor ion 310 in other product ion spectra produced over time using the collision energy used to produce FIG. 3. Intensity trace 620 of FIG. 6 is calculated from the intensity of precursor ion 320 in the product ion spectrum of FIG. 3 and from intensities of precursor ion 310 in other product ion spectra produced over time using the collision energy used to produce FIG. 3. Intensity trace 630 of FIG. 6 is calculated from the intensity of product ion 430 in the product ion spectrum of FIG. 5 and from intensities of product ion 430 in other product ion spectra produced over time using the collision energy used to produce FIG. 5. Intensity trace 640 of FIG. 6 is calculated from the intensity of product ion 440 in the product ion spectrum of FIG. 5 and from intensities of product ion 440 in other product ion spectra produced over time using the collision energy used to produce FIG. 5.

FIG. 6 shows that intensity trace 610 and 640 have a similar shape and retention time. In other words, intensity trace 610 and 640 are well correlated. As a result, it is likely that precursor ion 310 of FIG. 3 gave rise to product ion 440 of FIG. 5. Similarly, FIG. 6 shows that intensity trace 620 and 630 have a similar shape and retention time. In other words, intensity trace 620 and 630 are well correlated. Traces, or intensity traces, can be correlated by retention time, shape, and/or ion distribution function, for example. As a result, it is likely that precursor ion 320 of FIG. 3 gave rise to product ion 430 of FIG. 5.

In the various embodiments described above, increasingly higher collision energies are used to fragment the precursor ions. Collision energies are used in a collision-induced dissociation (CID) method. However, the systems and methods described herein are not limited to using collision energies of a CID method. Increasingly more aggressive values of a fragmentation parameter of any fragmentation method can be used. For example, increasingly more aggressive radio frequency (RF) excitations of an RF dissociation method can be used, or increasingly more aggressive electron energies of an electron capture dissociation (ECD) method can be used.

Also, in the various embodiments described above, the increase in collision energies is the same for all the mass isolation windows of the mass range. In various embodiments, the increase in collision energies or increase in aggressiveness of any fragmentation parameter value can vary or be a function of the increasing m/z of the mass isolation window.

System for Providing Precursor Ion Information

Figure 7:
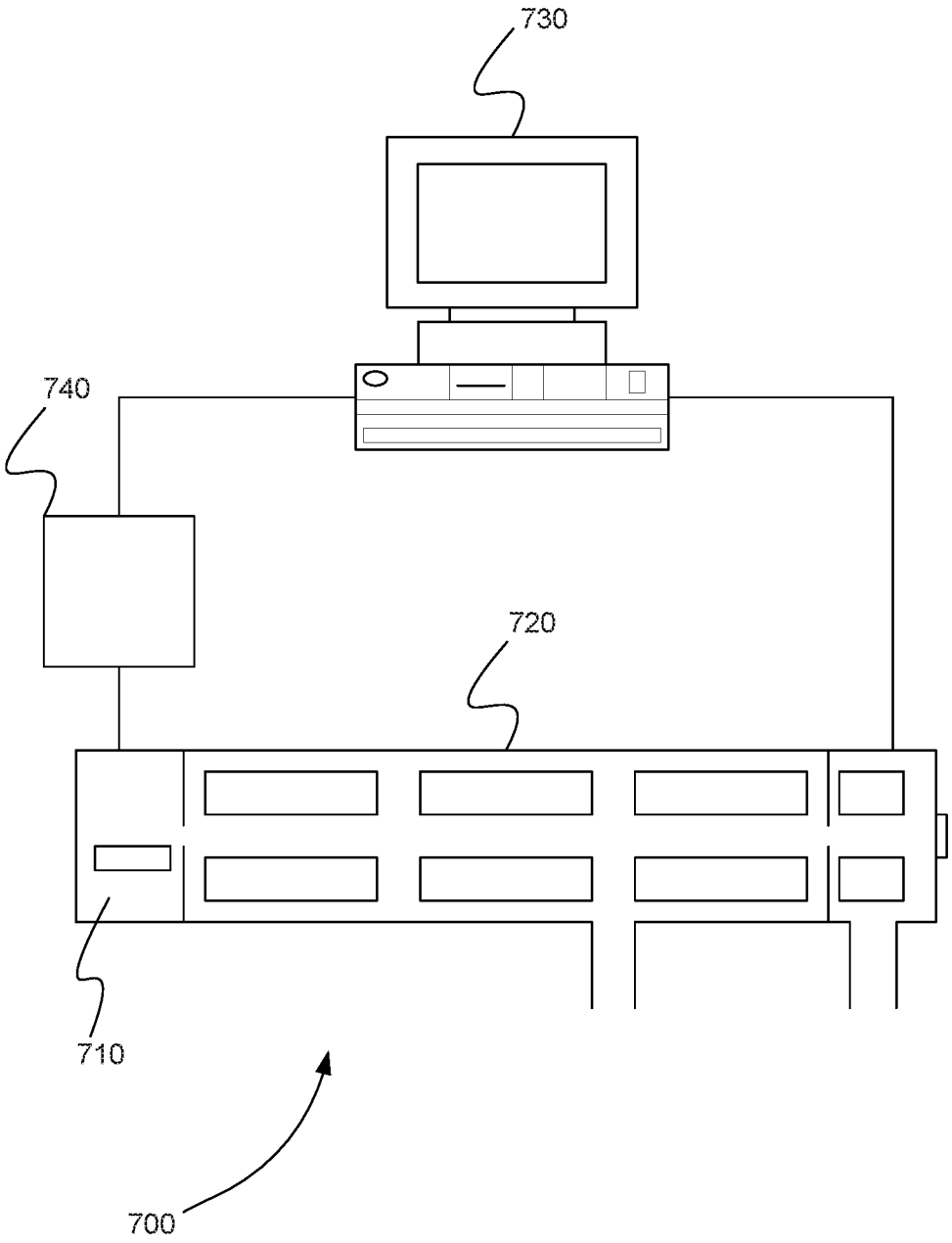
FIG. 7 is a schematic diagram of system for providing precursor ion information in a tandem mass spectrometry DIA experiment by fragmenting each precursor ion isolation window two or more times with different values for a fragmentation parameter, in accordance with various embodiments.

FIG. 7 is a schematic diagram 700 of system for providing precursor ion information in a tandem mass spectrometry DIA experiment by fragmenting each precursor ion isolation window two or more times with different values for a fragmentation parameter, in accordance with various embodiments.

System 700 includes ion source 710, tandem mass spectrometer 720, and processor 730. In various embodiments system 700 can also include sample introduction device 740. The sample introduction device 740 can provide a sample to ion source 710 using one of a variety of techniques. These techniques include, but are not limited to, gas chromatography (GC), liquid chromatography (LC), capillary electrophoresis (CE), or flow injection analysis (FIA).

Ion source 710 can be part of tandem mass spectrometer 720, or can be a separate device. Ion source 710 is configured to receive a sample and ionize the sample, producing an ion beam.

Tandem mass spectrometer 720, for example, can include one or more physical mass filters and one or more physical mass analyzers. A mass analyzer of tandem mass spectrometer 720 can include, but is not limited to, a time-of-flight (TOF), quadrupole, an ion trap, a linear ion trap, an orbitrap, or a Fourier transform mass analyzer.

Tandem mass spectrometer 720 is configured to receive the ion beam and analyze an m/z range of the ion beam.

Processor 730 can be, but is not limited to, a computer, microprocessor, or any device capable of sending and receiving control signals and data from tandem mass spectrometer 720 and processing data. Processor 730 can be, for example, computer system 100 of FIG. 1. In various embodiments, processor 730 is in communication with tandem mass spectrometer 720 and sample introduction device 710.

Processor 730 divides the m/z range into two or more precursor ion isolation windows. The m/z range and the window widths of the two or more precursor ion isolation windows are selected by a user, for example. Processor 730 selects two or more values for a fragmentation parameter. A first value of the two or more values for the fragmentation parameter has a level that fragments a minimal amount of ions of the ion beam. The one or more additional values of the two or more values for the fragmentation parameter have increasingly aggressive levels that produce increasingly more fragmentation of the ions of the ion beam.

For each precursor ion isolation window of the two or more precursor ion isolation windows, processor 730 instructs tandem mass spectrometer 720 to perform a selection and fragmentation of the ion beam using each precursor ion isolation window and using the first value. Processor 720 then instructs tandem mass spectrometer 720 to perform one or more additional selections and fragmentations of the ion beam using each precursor ion isolation window and using the one or more additional values. A product ion spectrum is produced for each value of the two or more values for the fragmentation parameter.

Figure 8:
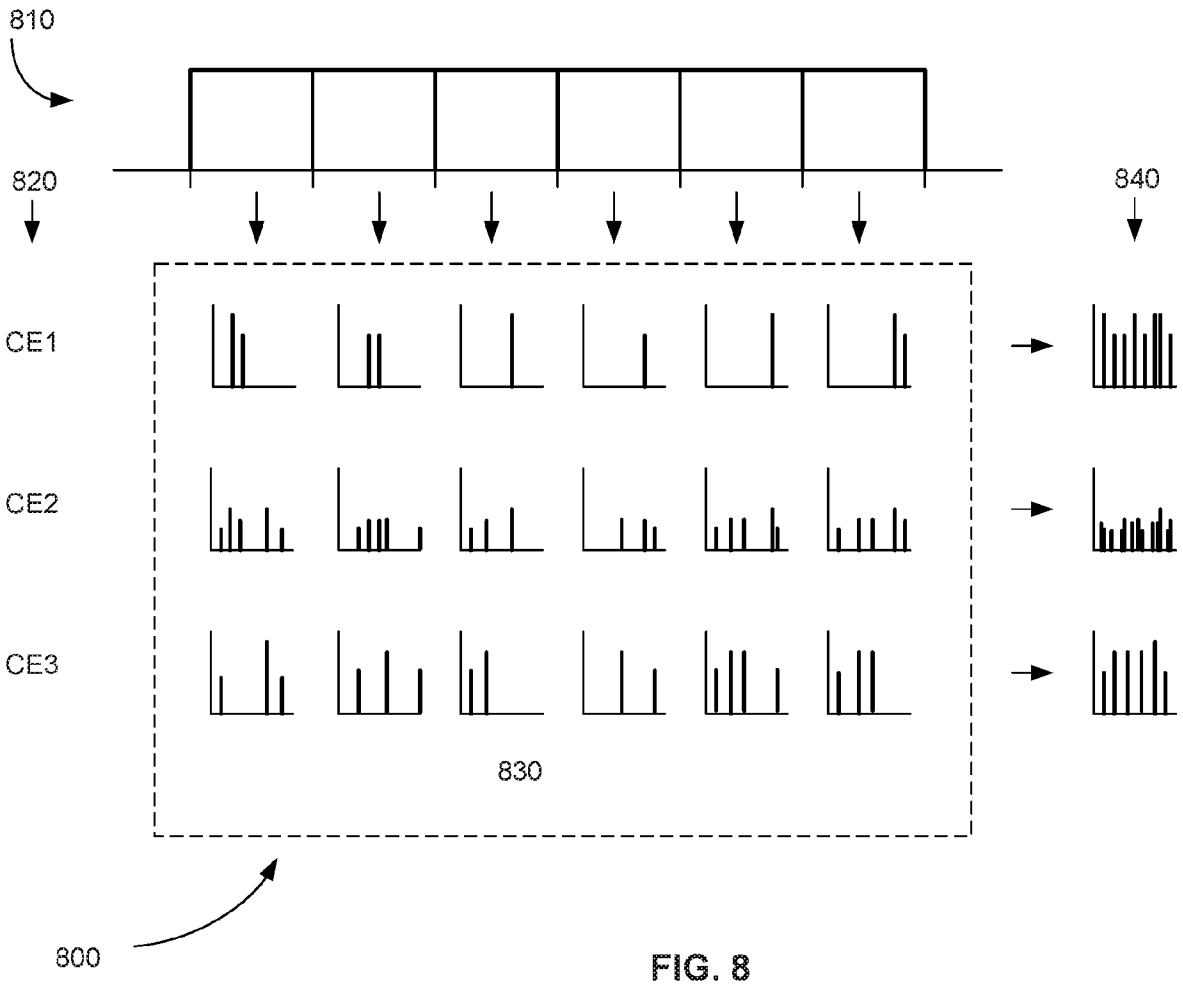
FIG. 8 is an exemplary diagram that graphically depicts the steps performed by the processor shown in FIG. 7 in analyzing an m/z range, in accordance with various embodiments.

FIG. 8 is an exemplary diagram 800 that graphically depicts the steps performed by processor 730 shown in FIG. 7 in analyzing an m/z range, in accordance with various embodiments. In step 810, an m/z range is divided into two or more precursor ion isolation windows. In step 820, two or more values for a fragmentation parameter are selected. In FIG. 8, the fragmentation parameter is shown as collision energy. In step 830, for each precursor ion isolation window of the two or more precursor ion isolation windows, tandem mass spectrometer 720 of FIG. 7 fragments the precursor ions in the precursor ion isolation window for each of the two or more values for the fragmentation parameter, producing a product ion spectrum for each value.

In various embodiments, processor 730 of FIG. 7 further combines product ion spectra of the two or more precursor ion isolation windows that were produced using the same value for the fragmentation parameter, producing for each of the two or more values for the fragmentation parameter a combined product ion spectrum for the entire m/z range. This is depicted as step 840 in FIG. 8, for example.

In various embodiments, sample introduction device 740 provides the sample to ion source 710 over time. Processor 730 then performs the steps depicted in FIG. 8 at one or more additional times. As a result, for each of the two or more values for the fragmentation parameter, a time series of combined product ion spectra is produced.

Figure 9:
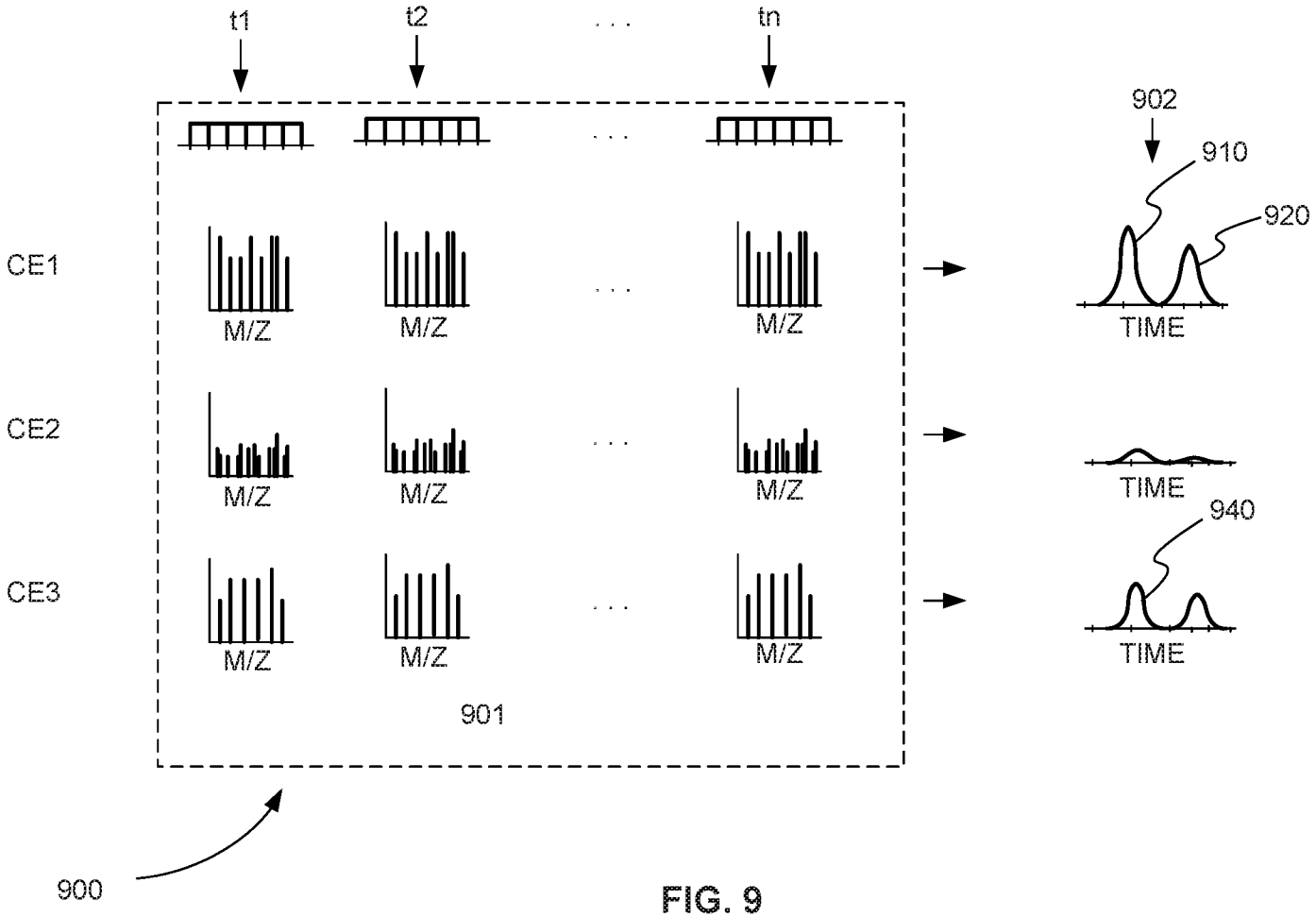
FIG. 9 is an exemplary diagram that graphically depicts the steps performed by the processor shown in FIG. 7 in analyzing an m/z range over time, in accordance with various embodiments.

FIG. 9 is an exemplary diagram 900 that graphically depicts the steps performed by processor 730 shown in FIG. 7 in analyzing an m/z range over time, in accordance with various embodiments. In step 901, at each time t1, t2, . . . , tn of the mass filtering of the m/z range is performed by Q1, a combined product ion spectrum is produced for each of the two or more values for the fragmentation parameter. As a result, each of the two or more values for the fragmentation parameter has a time series of combined product ion spectra.

Processor 730 of FIG. 7 further calculates an intact precursor ion intensity trace for each intact precursor ion in the time series of combined product ion spectra of the first value, producing one or more intact precursor ion intensity traces. Processor 730 also calculates at least one product ion intensity trace for at least one product ion in a time series of combined product ion spectra of the one or more additional values. This is depicted in step 902 in FIG. 9, for example.

Intact precursor ion intensity traces 910 and 920 are calculated for each intact precursor ion in the time series of combined product ion spectra of the first value. At least one product ion intensity trace 940 is calculated for at least one product ion in a time series of combined product ion spectra of the one or more additional values.

Processor 730 of FIG. 7 further compares the at least one product ion intensity trace to the one or more intact precursor ion intensity traces. If the at least one product ion intensity trace is correlated with an intact precursor ion trace of the one or more intact precursor ion intensity traces, processor 730 identifies an intact precursor ion of the intact precursor ion trace as producing the at least one product ion of the at least one product ion intensity trace.

Returning to FIG. 9, at least one product ion intensity trace 940 is compared to intact precursor ion intensity traces 910 and 920. If product ion intensity trace 940 is correlated with intact precursor ion intensity trace 910, for example, then the intact precursor ion of intact precursor ion intensity trace 910 is identified as producing the product ion of product ion intensity trace 940.

Processor 730 of FIG. 7 determines that the at least one product ion intensity trace is correlated with an intact precursor ion trace of the one or more intact precursor ion intensity traces by determining if an apex of the at least one product ion intensity trace appears at the same time as an apex of an intact precursor ion trace of the one or more intact precursor ion intensity traces, for example. Processor 730 further determines that the at least one product ion intensity trace is correlated with an intact precursor ion trace of the one or more intact precursor ion intensity traces by determining if a shape of the at least one product ion intensity trace is the same as a shape of an intact precursor ion trace of the one or more intact precursor ion intensity traces.

Method for Providing Precursor Ion Information

Figure 10:
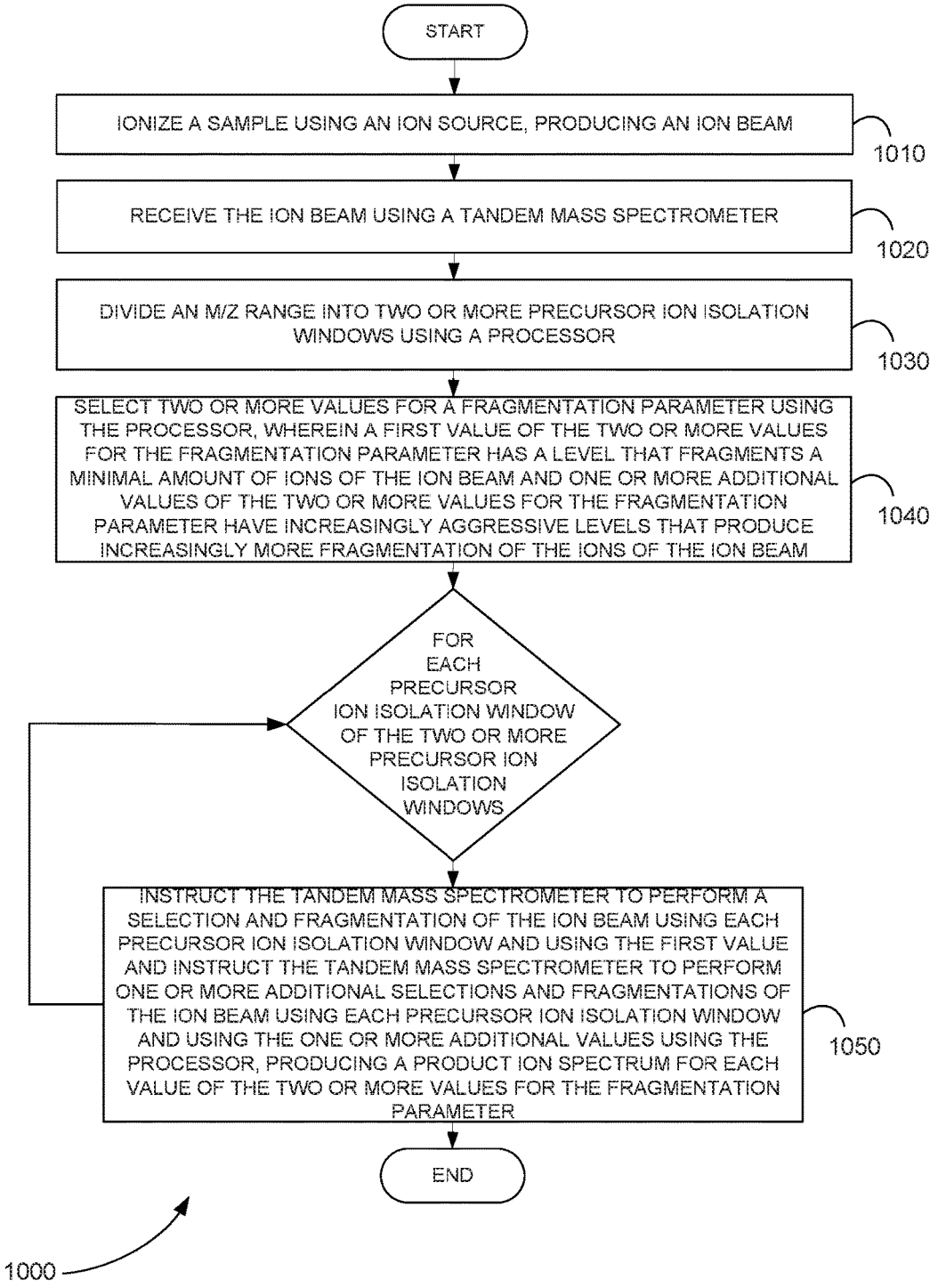
FIG. 10 is a flowchart showing a method for providing precursor ion information in a tandem mass spectrometry DIA experiment by fragmenting each precursor ion isolation window two or more times with different values for a fragmentation parameter, in accordance with various embodiments.

FIG. 10 is a flowchart showing a method 1000 for providing precursor ion information in a tandem mass spectrometry DIA experiment by fragmenting each precursor ion isolation window two or more times with different values for a fragmentation parameter, in accordance with various embodiments.

In step 1010 of method 1000, a sample is ionized using an ion source, producing an ion beam.

In step 1020, the ion beam is received using a tandem mass spectrometer.

In step 1030, an m/z range is divided into two or more precursor ion isolation windows using a processor.

In step 1040, two or more values for a fragmentation parameter are selected using the processor. A first value of the two or more values for the fragmentation parameter has a level that fragments a minimal amount of ions of the ion beam. The one or more additional values of the two or more values for the fragmentation parameter have increasingly aggressive levels that produce increasingly more fragmentation of the ions of the ion beam.

Step 1050 is executed for each precursor ion isolation window of the two or more precursor ion isolation windows. The tandem mass spectrometer is instructed to perform a selection and fragmentation of the ion beam using the each precursor ion isolation window and using the first value and is instructed to perform one or more additional selections and fragmentations of the ion beam using the each precursor ion isolation window and using the one or more additional values. A product ion spectrum is produced for each value of the two or more values for the fragmentation parameter.

Computer Program Product for Providing Precursor Ion Information

In various embodiments, computer program products include a tangible computer-readable storage medium whose contents include a program with instructions being executed on a processor so as to perform a method for providing precursor ion information in a tandem mass spectrometry DIA experiment by fragmenting each precursor ion isolation window two or more times with different values for a fragmentation parameter. This method is performed by a system that includes one or more distinct software modules.

Figure 11:
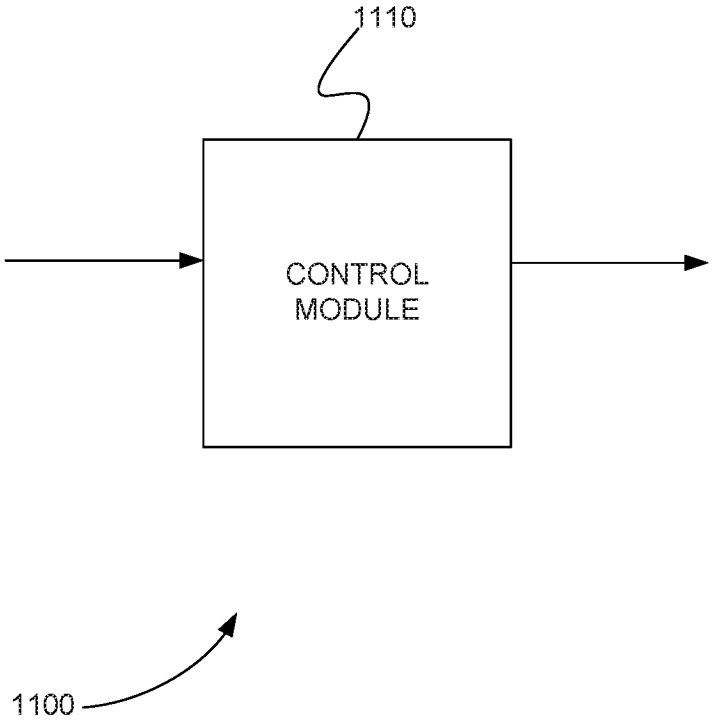
FIG. 11 is a schematic diagram of a system that includes one or more distinct software modules that performs a method for providing precursor ion information in a tandem mass spectrometry DIA experiment by fragmenting each precursor ion isolation window two or more times with different values for a fragmentation parameter, in accordance with various embodiments.

FIG. 11 is a schematic diagram of a system 1100 that includes one or more distinct software modules that performs a method for providing precursor ion information in a tandem mass spectrometry DIA experiment by fragmenting each precursor ion isolation window two or more times with different values for a fragmentation parameter, in accordance with various embodiments. System 1100 includes control module 1110.

Control module 1110 divides an m/z range of an ion beam to be analyzed by a tandem mass spectrometer into two or more precursor ion isolation windows. The tandem mass spectrometer receives the ion beam from an ion source that ionizes a sample. Control module 1110 selects two or more values for a fragmentation parameter. A first value of the two or more values for the fragmentation parameter has a level that fragments a minimal amount of ions of the ion beam. The one or more additional values of the two or more values for the fragmentation parameter have increasingly aggressive levels that produce increasingly more fragmentation of the ions of the ion beam.

For each precursor ion isolation window of the two or more precursor ion isolation windows, control module 1110 instructs the tandem mass spectrometer to perform a selection and fragmentation of the ion beam using the each precursor ion isolation window and using the first value and instructs the tandem mass spectrometer to perform one or more additional selections and fragmentations of the ion beam using the each precursor ion isolation window and using the one or more additional values. A product ion spectrum is produced for each value of the two or more values for the fragmentation parameter.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A system for providing precursor ion information in a tandem mass spectrometry data independent acquisition (DIA) experiment by fragmenting each precursor ion isolation window two or more times with different values for a fragmentation parameter, comprising:

an ion source configured to receive a sample and ionize the sample, producing an ion beam;

a tandem mass spectrometer configured to receive the ion beam and analyze an m/z range of the ion beam; and a processor in communication with the tandem mass spectrometer that (a) divides the m/z range into two or more precursor ion isolation windows, (b) selects two or more values for a fragmentation parameter, wherein a first value of the two or more values for the fragmentation parameter has a level that fragments a minimal amount of ions of the ion beam and one or more additional values of the two or more values for the fragmentation parameter have increasingly aggressive levels that produce increasingly more fragmentation of the ions of the ion beam, (c) for each precursor ion isolation window of the two or more precursor ion isolation windows, instructs the tandem mass spectrometer to perform a selection and fragmentation of the ion beam using the each precursor ion isolation window and using the first value and instructs the tandem mass spectrometer to perform one or more additional selections and fragmentations of the ion beam using the each precursor ion isolation window and using the one or more additional values, producing a product ion spectrum for each value of the two or more values for the fragmentation parameter, and (d) combines product ion spectra of the two or more precursor ion isolation windows that were produced using the same value for the fragmentation parameter, producing for each of the two or more values for the fragmentation parameter a combined product ion spectrum for the entire m/z range.

2. The system of claim 1, wherein the fragmentation parameter comprises a collision energy of a collision-induced dissociation method performed by the tandem mass spectrometer.

3. The system of claim 1, wherein the fragmentation parameter comprises a radio frequency (RF) excitation of an RF dissociation method performed by the tandem mass spectrometer.

4. The system of claim 1, wherein the fragmentation parameter comprises an electron energy of an electron capture dissociation (ECD) method performed by the tandem mass spectrometer.

5. The system of claim 1, further comprising a sample introduction device that provides the sample to the ion source over time and wherein the processor further performs steps (c) and (d) at one or more additional times, producing for each of the two or more values for the fragmentation parameter a time series of combined product ion spectra.

6. The system of claim 5, wherein the processor further calculates an intact precursor ion intensity trace for each intact precursor ion in the time series of combined product ion spectra of the first value, producing one or more intact precursor ion intensity traces and calculates at least one product ion intensity trace for at least one product ion in a time series of combined product ion spectra of the one or more additional values.

7. The system of claim 6, wherein the processor further compares the at least one product ion intensity trace to the one or more intact precursor ion intensity traces and if the at least one product ion intensity trace is correlated with an intact precursor ion trace of the one or more intact precursor ion intensity traces, identifies an intact precursor ion of the intact precursor ion trace as producing the at least one product ion of the at least one product ion intensity trace.

8. The system of claim 7, wherein the processor determines that the at least one product ion intensity trace is correlated with an intact precursor ion trace of the one or more intact precursor ion intensity traces by determining if an apex of the at least one product ion intensity trace appears at the same time as an apex of an intact precursor ion trace of the one or more intact precursor ion intensity traces.

9. The system of claim 7, wherein the processor further determines that the at least one product ion intensity trace is correlated with an intact precursor ion trace of the one or more intact precursor ion intensity traces by determining if a shape of the at least one product ion intensity trace is the same as a shape of an intact precursor ion trace of the one or more intact precursor ion intensity traces.

10. A method for providing precursor ion information in a tandem mass spectrometry data independent acquisition (DIA) experiment by fragmenting each precursor ion isolation window two or more times with different values for a fragmentation parameter, comprising:

(a) ionizing a sample using an ion source, producing an ion beam;

(b) receiving the ion beam using a tandem mass spectrometer;

(c) dividing an m/z range into two or more precursor ion isolation windows using a processor;

(d) selecting two or more values for a fragmentation parameter using the processor, wherein a first value of the two or more values for the fragmentation parameter has a level that fragments a minimal amount of ions of the ion beam and one or more additional values of the two or more values for the fragmentation parameter have increasingly aggressive levels that produce increasingly more fragmentation of the ions of the ion beam;

(e) for each precursor ion isolation window of the two or more precursor ion isolation windows, instructing the tandem mass spectrometer to perform a selection and fragmentation of the ion beam using the each precursor ion isolation window and using the first value and instructing the tandem mass spectrometer to perform one or more additional selections and fragmentations of the ion beam using the each precursor ion isolation window and using the one or more additional values using the processor, producing a product ion spectrum for each value of the two or more values for the fragmentation parameter; and (f) combining product ion spectra of the two or more precursor ion isolation windows that were produced using the same value for the fragmentation parameter, producing for each of the two or more values for the fragmentation parameter a combined product ion spectrum for the entire m/z range.

11. The method of claim 10, wherein the fragmentation parameter comprises a collision energy of a collision-induced dissociation method.

12. The method of claim 10, wherein the fragmentation parameter comprises a radio frequency (RF) excitation of an RF dissociation method.

13. The method of claim 10, wherein the fragmentation parameter comprises an electron energy of an electron capture dissociation (ECD) method performed by the tandem mass spectrometer.

14. The method of claim 12, further comprising performing steps (c) and (d) at one or more additional times as the sample is introduced over time to the ion source using a sample introduction device, producing for each of the two or more values for the fragmentation parameter a time series of combined product ion spectra.

15. The method of claim 14, further comprising calculating an intact precursor ion intensity trace for each intact precursor ion in the time series of combined product ion spectra of the first value, producing one or more intact precursor ion intensity traces and calculating at least one product ion intensity trace for at least one product ion in a time series of combined product ion spectra of the one or more additional values.

16. The method of claim 15, further comprising comparing the at least one product ion intensity trace to the one or more intact precursor ion intensity traces and if the at least one product ion intensity trace is correlated with an intact precursor ion trace of the one or more intact precursor ion intensity traces, identifying an intact precursor ion of the intact precursor ion trace as producing the at least one product ion of the at least one product ion intensity trace.

17. The method of claim 16, wherein determining that the at least one product ion intensity trace is correlated with an intact precursor ion trace of the one or more intact precursor ion intensity traces comprises determining if an apex of the at least one product ion intensity trace appears at the same time as an apex of an intact precursor ion trace of the one or more intact precursor ion intensity traces.

18. The method of claim 16, wherein determining that the at least one product ion intensity trace is correlated with an intact precursor ion trace of the one or more intact precursor ion intensity traces comprises determining if a shape of the at least one product ion intensity trace is the same as a shape of an intact precursor ion trace of the one or more intact precursor ion intensity traces.

19. A computer program product, comprising a non-transitory and tangible computer-readable storage medium whose contents include a program with instructions being executed on a processor so as to perform a method for providing precursor ion information in a tandem mass spectrometry data independent acquisition (DIA) experiment by fragmenting each precursor ion isolation window two or more times with different values for a fragmentation parameter, the method comprising:

providing a system, wherein the system comprises one or more distinct software modules, and wherein the distinct software modules comprise a control module;

dividing an m/z range of an ion beam to be analyzed by a tandem mass spectrometer into two or more precursor ion isolation windows using the control module, wherein the tandem mass spectrometer receives the ion beam from an ion source that ionizes a sample;

selecting two or more values for a fragmentation parameter using the control module, wherein a first value of the two or more values for the fragmentation parameter has a level that fragments a minimal amount of ions of the ion beam and one or more additional values of the two or more values for the fragmentation parameter have increasingly aggressive levels that produce increasingly more fragmentation of the ions of the ion beam;

for each precursor ion isolation window of the two or more precursor ion isolation windows, instructing the tandem mass spectrometer to perform a selection and fragmentation of the ion beam using the each precursor ion isolation window and using the first value and instructing the tandem mass spectrometer to perform one or more additional selections and fragmentations of the ion beam using the each precursor ion isolation window and using the one or more additional values using the control module, producing a product ion spectrum for each value of the two or more values for the fragmentation parameter; and combining product ion spectra of the two or more precursor ion isolation windows that were produced using the same value for the fragmentation parameter, producing for each of the two or more values for the fragmentation parameter a combined product ion spectrum for the entire m/z range.

* * * * *